US006520529B1

(12) United States Patent
DeRocco et al.

(10) Patent No.: US 6,520,529 B1
(45) Date of Patent: Feb. 18, 2003

(54) INTEGRATED MODULAR GLIDE BOARD

(75) Inventors: Anthony O. DeRocco, Seattle, WA (US); Bard Glenne, Nordland, WA (US); Paul Norton, Vashon, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 09/408,158

(22) Filed: Sep. 29, 1999

(51) Int. Cl.[7] ..... A63C 5/00
(52) U.S. Cl. ..... 280/610; 280/601; 280/602
(58) Field of Search ..... 280/14.21, 601, 280/602, 607, 608, 609, 610

(56) References Cited

U.S. PATENT DOCUMENTS

| | | | | |
|---|---|---|---|---|
| 2,258,046 A | | 10/1941 | Clement | |
| 2,539,224 A | | 1/1951 | Beerli | |
| 2,560,693 A | | 7/1951 | Hickman | |
| 3,260,532 A | | 7/1966 | Heuvel | |
| 3,414,279 A | | 12/1968 | Allain | |
| 4,679,813 A | | 7/1987 | Girard | |
| 4,681,725 A | | 7/1987 | Maruyama | |
| 4,697,821 A | | 10/1987 | Hayashi et al. | |
| 5,026,086 A | | 6/1991 | Guers et al. | |
| 5,035,442 A | | 7/1991 | Arnsteiner | |
| 5,249,819 A | | 10/1993 | Mayr | |
| 5,251,924 A | | 10/1993 | Nussbaumer | |
| 5,301,965 A | | 4/1994 | Floreani | |
| 5,366,234 A | * | 11/1994 | Rohrmoser | 280/610 |
| 5,393,086 A | * | 2/1995 | Le Masson et al. | 280/602 |
| 5,397,150 A | * | 3/1995 | Commier et al. | 280/607 |
| 5,441,296 A | * | 8/1995 | Phelipon et al. | 280/602 |
| 5,447,322 A | * | 9/1995 | le Masson et al. | 280/602 |
| 5,501,825 A | * | 3/1996 | Jodelet | 264/46.5 |
| 5,820,154 A | * | 10/1998 | Howe | 280/602 |
| 5,884,934 A | * | 3/1999 | DeRocco et al. | 280/607 |
| 5,895,067 A | | 4/1999 | Stephanova et al. | |
| 5,944,335 A | * | 8/1999 | Riepler | 280/602 |
| RE36,453 E | * | 12/1999 | Abondance et al. | 280/609 |

FOREIGN PATENT DOCUMENTS

| | | |
|---|---|---|
| DE | 3315638 | 12/1983 |
| DE | 41 30 110 A1 | 2/1992 |
| EP | 0 563 569 A1 | 10/1993 |
| EP | 0 577 947 A1 | 1/1994 |
| FR | 2 693 379 | 1/1994 |
| NO | 73456 | 4/1948 |
| WO | WO 91/09653 | 7/1991 |
| WO | WO 99/43397 | 9/1999 |

* cited by examiner

*Primary Examiner*—Brian L. Johnson
*Assistant Examiner*—J. Allen Shriver
(74) *Attorney, Agent, or Firm*—Christensen O'Connor Johnson Kindness PLLC

(57) ABSTRACT

A ski (10) includes a body (22) formed from a primary core (28) reinforced by a structural layer (30) that wraps the primary core. A secondary core (24) is disposed above the body and adhered thereto with an elastomeric layer (32). A top layer (40) overlies the secondary core and the exposed portions of the body to integrate the secondary core into the ski. The ski further includes a bottom layer (34) reinforced with edge strips (36). The secondary core (24) provides additional mass at selected regions of the ski without significantly impacting the stiffness of the ski, thereby affecting the dynamic profile of the ski.

20 Claims, 3 Drawing Sheets

INTEGRATED MODULAR GLIDE BOARD

FIELD OF THE INVENTION

The present invention relates to the construction of glide boards and particularly to methods of mass distribution in a snow ski.

BACKGROUND OF THE INVENTION

The distribution of mass along the length of an alpine ski is a key element that affects the dynamics of ski performance. The same consideration also applies to Nordic skis and snowboards. Mass distribution impacts the modal and nodal vibrational properties of the ski structure, which in turn determines how the ski handles shock and vibration.

Conventionally, skis were fashioned from solid or laminated wood. In more recent years, skis have been constructed from a core, formed of wood or foam, that is sandwiched between or encased by load carrying structural layers having a constant thickness. The structural layers may be formed of glass, carbon or polyaramide fiber reinforced resins or aluminum alloys, for example. The stiffness profile of the ski along its length, vital to performance, is conventionally obtained by varying the thickness of the core. The result of this is that the distribution of mass along the length of the conventional ski is coupled to the stiffness of the ski, both of which are determined primarily by the core thickness. A thicker core results in a larger beam formed from the load carrying layers that surround the core, and vice versa. A thinner core results in a smaller beam and less stiffness. This has meant that for conventional skis only relatively small variations in ski mass distributions are possible. It has thus been necessary to change ski length, change the mass of the ski tips, or to add external weights to alter a ski's dynamic behavior.

Other types of conventional skis have used a split core construction, i.e., a ski core formed from first and second core layers joined by an elastomeric layer. However, these split cores are still sandwiched between or encased by load carrying structural layers, thus again coupling ski stiffness and mass distribution.

SUMMARY OF THE INVENTION

The present invention provides an elongate glide board defining a fore body portion and a rear body portion. The glide board includes a body formed from a primary core reinforced by at least one load carrying structural layer. A secondary core overlies at least portions of the body outside of the at least one load carrying structural layer. A top layer covers at least the secondary core and any exposed portions of an upper surface of the body. A base layer covers a lower outer surface of the body.

In further aspects of the invention, an elongate glide board includes a longitudinal primary core defining upper and lower surfaces. A load carrying structural layer wraps at least the upper and lower surfaces of the primary core and defines corresponding upper and lower outer surfaces. A secondary core at least partially overlies the upper outer surface of the structural layer, above the primary core. A top layer covers at least the secondary core and any exposed portions of the upper outer surface of the structural layer. A base layer covers the lower outer surface of the structural layer below the primary core.

In a further aspect of the present invention, a method of fabricating an elongate glide board is provided. The method entails wrapping at least upper and lower surfaces of a longitudinal primary core with a load carrying structural layer. The load carrying structural layer defines corresponding upper and lower outer surfaces. The method further entails overlying at least a portion of the upper outer surface of the structural layer with a secondary core. A top layer is applied over at least the secondary core and any exposed portions of the upper outer surface of the structural layer. A base layer is applied over the lower outer surface of the structural layer below the primary core.

The present invention thus provides a method to decouple mass distribution along the length of a ski from ski stiffness. The provision of a modular or secondary core positioned above the primary core, and outside of the beam formed from the structural reinforcing layers, enables the provision of increased total core thickness at desired locations along the length of the ski without a corresponding increase in ski stiffness. By constructing a ski with a secondary core disposed above the primary core and all of the major load carrying structural layers, core weight can be added to locations of the ski forward and rearward of the binding zone. In addition to determining the dynamic properties of the ski, the provision of a modular second core can reduce the effects of impact loads encountered by the ski tips.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
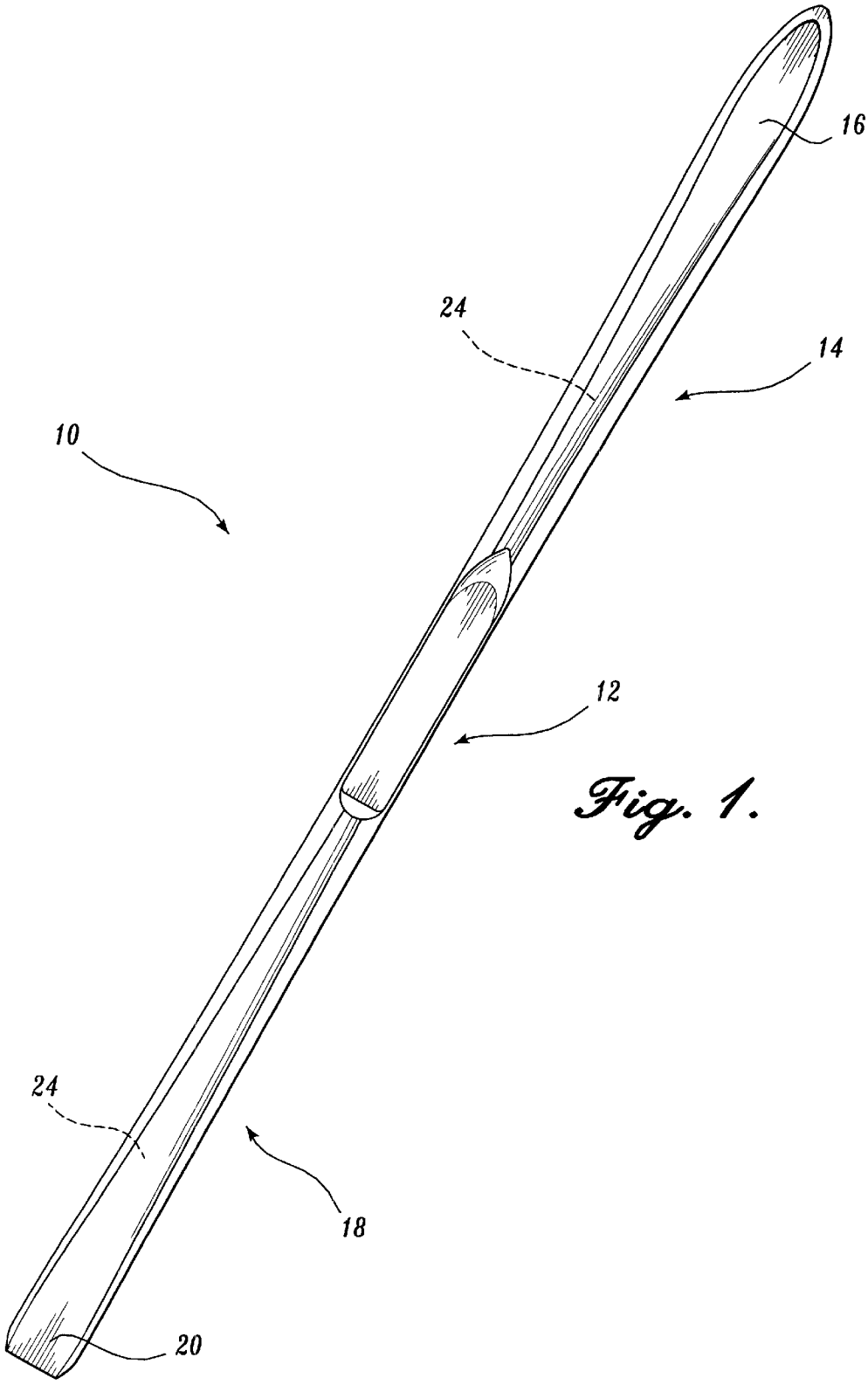
FIG. 1 provides a plan view of a ski constructed in accordance with a preferred embodiment of the present invention.

A preferred embodiment of a ski 10 constructed in accordance with the present invention is illustrated in FIG. 1. The elongate ski defines a flat central binding portion 12 to which the ski binding is mounted for fastening to a ski boot. The ski defines a fore body portion 14 terminating in a tip 16, and a rear body portion 18 terminating in a tail 20. As used herein, the term forwardly refers to the direction extending along longitudinal axis of the ski towards the tip 16, while the term rearwardly refers to the opposite direction.

While the preferred embodiment of the invention is illustrated in the form of an alpine ski 10, it should be readily appreciated that the foregoing may also be adapted for use in Nordic skis, snowboards, and other glide boards to effectuate a change in the mass distribution along the length of the board and thereby determine the dynamic profile of the glide board.

Figure 2:
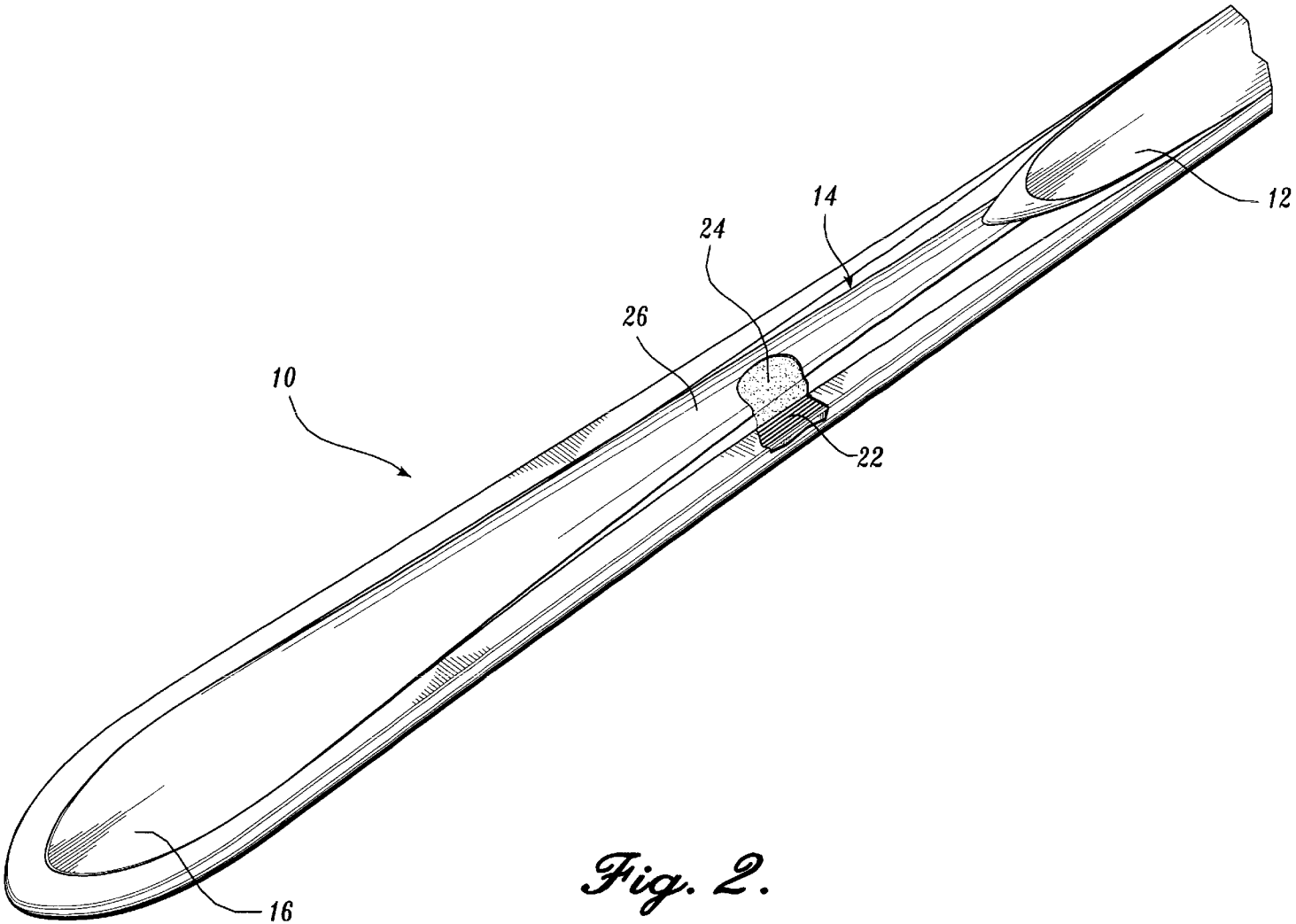
FIG. 2 provides a pictorial view of the fore body portion of the ski of FIG. 1, with a segment of the top layer removed to expose the secondary core.

Referring to FIG. 1 and FIG. 2, the ski 10 is formed from an internal body 22, as shall be described subsequently. In order to determine the mass distribution along the length of the ski, a secondary core 24 is applied along the length of, or portions of, the ski above the body 22. The secondary core 24 and body 22 are capped on the upper surface by a top layer 26. The secondary core 24 defines a ridge running along the length of the ski, below the top layer 26, that varies in width and height as desired for a predetermined mass distribution and dynamic profile. In the preferred embodiment illustrated in FIG. 2, the height or thickness of the secondary core 24 is greatest just forwardly of the binding zone 12. As the secondary core 24 extends forwardly along the length of the ski, it increases in width while initially remaining relatively constant in thickness. As the secondary core 24 extends further along the length of the fore body portion 14, it begins to taper in thickness while expanding in width, terminating just before the tip 16. This results in an increased mass of secondary core 24 in the fore body portion region just forwardly of the binding zone 12.

In the preferred embodiment of FIGS. 1 and 2, the secondary core 24 also extends in a thin layer below the binding portion 12. The secondary core 24 thus serves as an integral ski lifter. In the embodiment illustrated in FIG. 1, the secondary core 24 also extends rearwardly of the binding portion 12 in a fashion similar to the forward extension, so as to increase the mass of the secondary core 24 in the segment of the rear body portion 18 just rearwardly of the binding portion 12.

While the preferred embodiment of FIGS. 1 and 2 includes the secondary core 24 extending continuously along the length of the ski 10, with a minimum thickness below the binding portion 12 and increased mass forwardly and rearwardly of the binding portion 12, alternate configurations are within the scope of the present invention as may be desired to provide a ski with a given dynamic response profile. Thus, the secondary core 24 may be included only in the fore body portion 14, or only in the rear body portion 18. Further, rather than varying continuously as illustrated in FIG. 1, the thickness and width of the secondary core 24 may vary discontinuously as desired to concentrate mass over a given region of the ski. Build-up of mass through increased thickness of the secondary core 24 has a greater impact on ski performance the further the location of the build-up from the binding zone 12.

Figure 3:
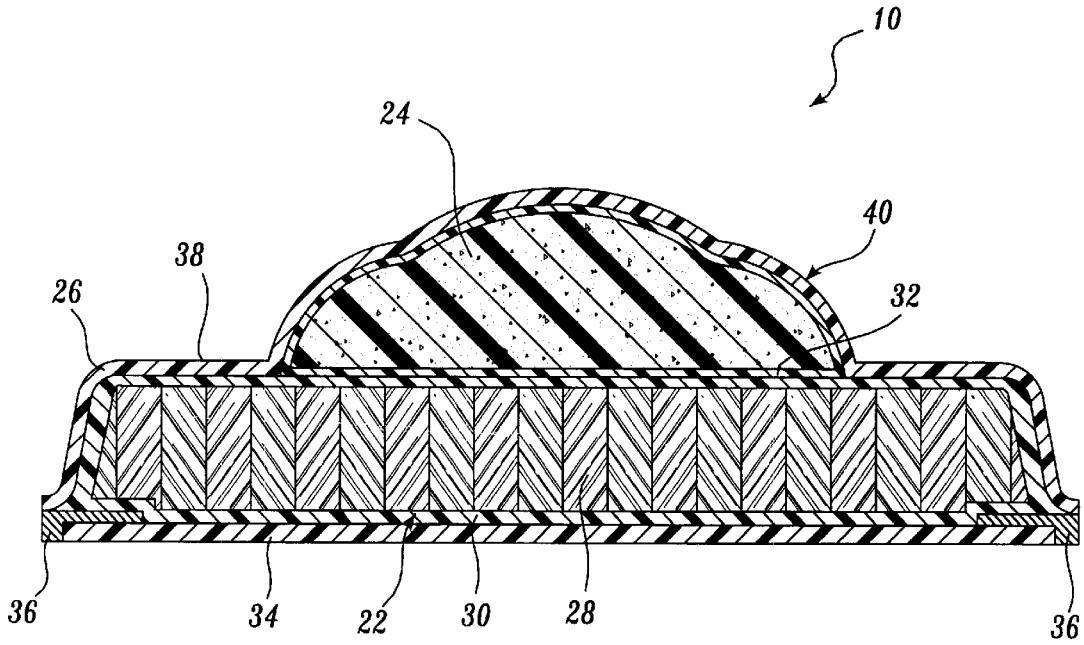
FIG. 3 provides a transverse cross section of the ski of FIG. 1 taken through the ski at a point forward of the binding zone.

Attention is now directed to FIG. 3 to describe the construction of the ski 10 in greater detail. The ski 10 is constructed from a conventional primary core 28. As illustrated, the primary core 28 is formed from laminated wood, however, other known core materials such as a rigid structural urethane foam or other polymer foams may be utilized. The primary core 28 is surrounded by a load bearing, structural reinforcing layer 30. In the preferred embodiment, the structural layer 30 wraps the upper and lower surfaces as well the sides of the primary core 28. However, in other types of conventional ski construction, also suitable for use in the present invention, the structural layer 30 may cover only the upper and lower surfaces of the primary core 28. Suitable materials for use in the structural layer 30 are known, such as fiber reinforced resins, e.g., polyester or epoxy resin reinforced with glass, polyaramide carbon fibers. Metals may also be incorporated into the core or structural reinforcing layer 30. The structural layer 30 may be single or multiple plys. The primary core 28 and surrounding structural layer 30 form the body 22 of the ski 10.

The secondary core 24 is disposed above the body 22, and thus above the primary core 28 and the upper outer surface of the structural layer 30. In the embodiment illustrated, the secondary core 24 is formed from a rigid structural foam such as a urethane foam. However, other core materials such as wood may alternately be utilized. Differing materials with differing densities, with or without volume change of secondary core along the length of the ski, may be utilized to form a secondary core with greater mass distribution. Thus first and second foam materials having first and second densities can be used to form the secondary core. The secondary core 24 is outside of and sits above the structural beam formed by the primary core 28 and the surrounding structural layer 30. Thus, the secondary core 24 does not significantly alter the stiffness of the ski. To further prevent an affect on the stiffness of the ski, the ski 10 preferably includes a thin elastomeric layer 32 between the lower surface of the secondary core 24 and the upper surface of the structural layer 30. This presents and enables limited shearing motion between the secondary core 24 and the body 22, which also serves to absorb shock.

The ski 10 further includes a top layer 26 or cap that overlies the upper surface of the secondary core 24, the exposed side portions of the upper surface of the structural layer 30 and, in the preferred embodiment illustrated, extends downwardly over the sides of the structural layer 30 as well. The preferred embodiment also preferably includes the elastomeric layer 32 extending between the upper surface of the secondary core 24 and the top layer 26. This facilitates shear between the secondary core 24 and the top layer 26. However, this is not as significant as is the presence of the elastomeric layer 32 between the secondary core 24 and the structural layer 30.

While the preferred embodiment of the ski 10 is illustrated as including a cap-type top layer 26 that extends downwardly to cover the sides of the body 22, other conventional constructions such as a top layer that covers only the upper surface of the ski and leaves the sides exposed to be covered with a separate sidewall layer are also within the scope of the present invention.

The ski is completed by a bottom layer 34 that underlies the lower outer surface of the structural layer 30, below the primary core 28. The edges of the bottom layer 34 are preferably reinforced with metal, such as steel edge strips 36. Materials for the top layer 26 and the bottom layer 34 are known in the art, including plastics such as urethane, acrylics, copolymers, and polyimide. Preferably, the top layer is formed from a pliant polymeric material, such as polyurethane, and the bottom layer (or base) of polyethylene.

Thus, referring to FIG. 3, it can be seen that ski 10 includes a secondary core 24 that is disposed above all major load carrying structures. The secondary core 24 thus affects overall ski stiffness minimally while adding mass to selected areas of the ski.

Referring to the profile shown in FIG. 3, it can be seen that the upper surface 38 defines a central ridge 40 under which the secondary core 24 is encased. The contour of the secondary core 24 illustrated is representative and may be varied as desired. The secondary core 24 is adhered firmly and nonremovably in place by the elastomeric layer 32 to the body 22 but may undergo limited shear movement. By covering the secondary core 24 with the top layer 40, the module represented by the secondary core 24 is permanently integrated with the module represented by the primary core 28.

The modular ski constructed in accordance with the present invention including a binary core, provides an integrated high performance suspension system for the ski. The secondary core 24 and elastomeric layer 32 insulates the skier from impact loads and vibrations in variable conditions, providing maximum edge-to-snow contact and a higher degree of control, power, ease and forgiveness. In a preferred embodiment, the elastomeric composite module defined by the secondary core 24 and elastomeric layer 32, extends from tip to tail. The secondary core 24 allows the body 22 of the ski to act independently under foot, while the secondary core 24 absorbs and insulates the skier from snow inconsistencies and impact loads. The preferable extension of the secondary core 24 into the fore body and rear body portions to the tip and tail, respectively, enables better edge control to be maintained during flexing of the ski. As the tip or tail of the ski flexes upwardly, for example, the secondary core 24 is able to move or extend longitudinally toward the tip or tail due to shearing in the elastomeric layer 32, thereby maintaining better edge-to-snow contact.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An elongate glide board defining a fore body portion and a rear body portion, comprising:

a longitudinal primary core defining upper and lower surfaces;

a load carrying structural layer wrapping at least the upper and lower surfaces of the primary core and defining corresponding upper and lower outer surfaces, the primary core and structural layer forming a structural beam having a stiffness;

a secondary core at least partially overlying the upper outer surface of the structural layer, above the primary core and extending into the fore and rear body portions substantially to at least one of a tip and tail without substantially changing the stiffness of the structural beam, and outside of the structural beam defined by the primary core and structural layer, further comprising a thin elastomeric shear layer disposed between the secondary core and the upper outer surface of the structural layer extending into the fore and rear body portions substantially to at least one of a tip and tail;

a top layer covering the secondary core and at least segments of any exposed portions of the upper outer surface of the structural layer; and a base layer covering the lower outer surface of the structural layer, below the primary core.

2. The glide board of claim 1, wherein the secondary core is disposed above the primary core in the fore body portion of the glide board.

3. The glide board of claim 2, wherein the secondary core varies in width and height along the length of the glide board.

4. The glide board of claim 1, wherein the secondary core is disposed above the primary core in the rear body portion of the glide board.

5. The glide board of claim 4, wherein the secondary core varies in width and height along the length of the glide board.

6. The glide board of claim 1, wherein the secondary core varies in length and width along the length of the glide board.

7. The glide board of claim 1, wherein the secondary core extends below a binding zone defined by the top layer of the glide board and further extends and increases in thickness forwardly or rearwardly thereof.

8. The glide board of claim 1, wherein the secondary core is constructed from a material selected from the group consisting of wood and polymeric foam.

9. The glide board of claim 1, wherein the top layer covers an upper surface of the secondary core and extends downwardly to cover the sides of the primary core.

10. The glide board of claim 1, wherein the elastomeric layer surrounds the secondary core between the upper surface of the structural layer and the top layer.

11. The glide board of claim 1, wherein the secondary core is integrated into the glide board and is covered only by the top layer.

12. The glide board of claim 1, wherein the load carrying structural layer defines an upper plane, and the secondary core is disposed above the upper plane of the load carrying structural layer.

13. The glide board of claim 1, wherein the secondary core comprises first and second materials of differing densities.

14. An elongate glide board defining a fore body portion, a central binding portion and a rear body portion, comprising:

a longitudinal primary core defining upper and lower surfaces;

a load carrying structure including a load carrying structural layer wrapping at least the upper and lower surfaces of the primary core and defining corresponding upper and lower outer surfaces, the primary core and structural layer forming a major structural beam having a stiffness;

a secondary core at least partially overlying the upper outer surface of the structural layer, above the primary core and the load carrying structure, so as to be outside of the major structural beam defined by the primary core and structural layer, within the fore body portion, the central binding portion and the rear body portion, the secondary core varying in weight distribution along the length of the glide board without substantially changing the stiffness of the major structural beam;

a top layer covering the secondary core and at least segments of any exposed portions of the upper outer surface of the structural layer; and a base layer covering the lower outer surface of the structural layer below the primary core.

15. An elongate glide board defining a fore body portion, a central binding portion and a rear body portion, comprising:

a body formed from a primary core reinforced by at least one load carrying structural layer;

a secondary core at least partially overlying portions of the body above the at least one load carrying structural layer so as to be outside of a major structural beam having a stiffness defined by the body, within the fore body portion, central binding portion and the rear body portion, the secondary core varying in weight distribution along the length of the glide board without substantially changing the stiffness of the major structural beam and tapering in width along at least a portion of the fore body portion approaching the central binding portion;

a top layer covering at least portions of the secondary core and integrating the secondary core onto the body; and a base layer covering the lower outer surface of the body.

16. The glide board of claim 15, further comprising an elastomeric layer disposed between the secondary core and an upper surface of the body.

17. The glide board of claim 15, wherein the secondary core varies in height along the length of the body.

18. A method of fabricating an elongate glide board defining a fore body portion and a rear body portion comprising:

wrapping at least upper and lower surfaces of a longitudinal primary core with a load carrying structural layer; the load carrying structural layer defining corresponding upper and lower outer surfaces;

overlying at least a portion of the upper outer surface of the structural layer with a thin elastomeric shear layer;

overlying the elastomeric shear layer with a secondary core, wherein the elastomeric shear layer and the secondary core extend into the fore body and rear body portions and substantially to at least one of a tip and tail and are outside of a major structural beam having a bending stiffness and defined by the primary core and the load carrying structural layer, wherein the secondary core does not substantially change the bending stiffness of the major structural beam;

applying a top layer over the secondary core and at least segments of any exposed portions of the upper outer surface of the structural layer; and applying a base layer over the lower outer surface of the structural layer below the primary core.

19. The method of claim 18, further comprising varying the width and thickness of the secondary core along the length of the primary core to vary the weight distribution therealong.

20. The method of claim 18, further comprising applying an elastomeric layer over the secondary core, between the secondary core and the top layer.

* * * * *